US008154313B1

(12) United States Patent
Cantolino

(10) Patent No.: US 8,154,313 B1
(45) Date of Patent: Apr. 10, 2012

(54) WATER DETECTION ASSEMBLY FOR PRIMARY DRAIN LINES

(76) Inventor: Christopher Ralph Cantolino, Bradenton, FL (US)

( * ) Notice: Subject to any disclaimer, the term of this patent is extended or adjusted under 35 U.S.C. 154(b) by 386 days.

(21) Appl. No.: 12/565,765

(22) Filed: Sep. 24, 2009

(51) Int. Cl.
*G01R 31/00* (2006.01)
*G01R 29/00* (2006.01)

(52) U.S. Cl. ..... 324/750.01; 324/750.14; 324/694; 324/696

(58) Field of Classification Search ..... 324/694–696; 73/863–863.03; 340/606–620
See application file for complete search history.

(56) References Cited

U.S. PATENT DOCUMENTS

| | | | | |
|---|---|---|---|---|
| 5,546,009 | A * | 8/1996 | Raphael | 324/694 |
| 7,019,541 | B2 * | 3/2006 | Kittrell | 324/696 |
| 2006/0125646 | A1 * | 6/2006 | McPherson | 340/603 |
| 2006/0208915 | A1 * | 9/2006 | Oakner et al. | 340/620 |

* cited by examiner

*Primary Examiner* — Huy Q Phan
*Assistant Examiner* — Emily Chan
(74) *Attorney, Agent, or Firm* — Dorothy S. Morse

(57) ABSTRACT

A water detection assembly having an electronic fluid-sensing probe located in-line within a primary drain line associated with a fluid-producing unit via probe connection to an access port used for clearing and removing clog-causing debris from the primary drain line. The probe has no moving parts and quick-disconnect connection to a signal-generating unit. The access port is configured for vertical or horizontal installation and introduction of chemicals to clean the drain without retrograde backflow into the fluid-producing unit. The probe is inserted into the access port through a longitudinal opening when vertically installed, and alternatively through a lateral opening in a horizontal installation. When the probe detects fluid, the connected signal-generating unit sends an electronic signal that shuts off fluid production, activates an alarm or pump, and/or provides remote notification. One of the two power potentials in the electronic fluid-sensing probe needed for signal generation may have a circular configuration.

20 Claims, 15 Drawing Sheets

WATER DETECTION ASSEMBLY FOR PRIMARY DRAIN LINES

CROSS-REFERENCES TO RELATED APPLICATIONS

This application relates to a U.S. patent application filed by the same inventor on Dec. 17, 2008, having the title of "Fluid-Sensing Switch System With Redundant Safety Response Capability", an assigned application Ser. No. 12/337,574. The overlapping subject matter between this previously filed utility patent application and the current application herein lies in the disclosure of the signal-generating unit (herein referred to by the component number 4). The applicant requests domestic priority for the current application herein relating to the signal-generating units both inventions employ.

BACKGROUND

1. Field of the Invention

The present invention generally relates to water detection systems associated with heating, ventilating, and air conditioning (HVAC) systems and other fluid-producing units, specifically to a water detection assembly having an electronic fluid-sensing probe with in-line positioning inside the primary drain line connected to a fluid-producing unit. In-line positioning for the electronic fluid-sensing probe is achieved via connection to an access port (also referred to herein as a cleanout unit/device) that is used for easy and fast clearing/removing of clog-causing debris from the primary drain line. The unique design of the access port's insulated housing provides a step-down fluid-collection area having an elevation lower than the bottom inside surface of the connected primary drain line segment located upstream of the access port, whether the access port is installed in a vertical or horizontal orientation. The probe is placed into a fixed position adjacent to this step-down fluid-collection area, out of the normal flow of fluid that travels from the connected fluid-producing unit, through the access port, and further down the primary drain line. It is only when a blockage occurs that the step-down fluid-collection area begins to fill with fluid, and when the amount of fluid in the step-down area reaches a threshold amount no longer considered safe (with backflow into portion of the primary drain line leading to the fluid-producing unit an imminent possibility), the rising fluid will come into contact with both of the power potentials in the present invention fluid-sensing probe, thus causing activation of a connected signal-generating unit that promptly sends an electronic signal to shut off fluid production, activate an alarm or pump, and/or provide remote notification, before rising fluid is able to move out of the step-down fluid-collection area toward the fluid-producing unit and place it at risk for damage. The unique design of the access port also allows for removal of the fluid-sensing probe, and introduction of chemicals into the drain line without any worry of retrograde backflow of the chemicals into the associated HVAC system or fluid-producing other unit. The present invention fluid-sensing probe is sealed within the access port using a longitudinal/end opening when the access port is vertically installed, and in the alternative, through a side/laterally positioned opening in the access port when it is horizontally installed. In its horizontal and vertical orientations, fluid flow through the access port occurs in opposite directions. Therefore, information markings on the outside of the access port are important to remind an installer of the needed direction of fluid flow through it to achieve a proper installation. Furthermore, the electronic fluid-sensing probe of the present invention preferably has a quick-disconnect connection to the signal-generating unit, and is without moving parts, which avoids the causes of failure common to pan-mounted water sensors having a deployable float, that include but are not limited to, inadequate leveling of the float body during installation relative to the pan wall supporting it, mounting to an insubstantial pan wall that leans-in over time, and the presence of mold, algae, and/or other interfering debris that accumulates over time on the movable float and prevents its proper deployment in response to rising fluid in the pan. When the present invention probe is in its usable position within the step-down fluid-collection area and detects fluid, the fluid completes a circuit that causes the connected signal-generating unit to send an electronic signal that shuts off fluid production, activates an alarm or pump, and/or provides remote notification to one or more locations. One of the two power potentials in the probe needed for signal generation has distal end positioning at a higher elevation than the other, and extends through its false-trigger-reducing resilient piece in a position to wait for rising fluid, without premature activation. The resilient piece has opposing ends and a cone associated with each opposing end, one of which provides a drip path to wick fluid away from the more highly elevated power potential. One of the two power potentials used may also have a circular configuration. The association of the present invention probe with a threaded cap intended for sealing a clean-out opening in the access port is also contemplated. In addition, the signal-generating unit connected to the fluid-sensing probe is preferably attached to the fluid-producing unit, a nearby wall, a secondary drain pan, or other support surface, via double-sided tape and/or fasteners.

2. Description of the Related Art

Air handling systems such as furnaces or other heating, ventilating, or air conditioning (HVAC) systems associated with a building structure typically have a primary drain pan, but may also have a secondary drain pan underneath at least a portion of the air handling unit to catch collected condensation and prevent damage the unit itself, and/or its surroundings, that otherwise might result from excess fluid collection and overflow. Furthermore, the condensation produced in a twenty-four hour period can be more than the primary or secondary drain pans can hold. This is a particularly common occurrence with some air conditioning systems. Therefore, the secondary drain pans used therewith are often mounted in a non-level orientation and connected to a drain pipe or hose that carries the collected condensate to a suitable remote location. However, in some fluid collection applications the removal of excess condensate from a secondary drain pan requires pumping. A fluid level sensing unit is also typically associated with a secondary drain pan, which is activated when the fluid level in the pan exceeds a threshold level considered safe. When that threshold is reached, the fluid level sensing unit generates a signal and sends it to a water sensor switching circuit to activate the pump. When sufficient water is removed from the drain pan by the pump to allow the water sensor to stop sending the activation signal to it, the pump becomes inactivated. In this manner, the pump is only activated when necessary to pump water out of the drain pan, thereby prolonging the life of the pump, while preventing water from overflowing the vertically-extending walls of the secondary drain pan.

Many prior art fluid level sensors in current use contain an upwardly-deployable float. One disadvantage of its use is that it may require time-consuming installation to level the float for proper and reproducible operation, or to place it at the proper height for shut-off signal activation when water depth in the associated secondary pan exceeds a threshold level considered safe to avoid damage to the fluid-producing unit and its surroundings, taking into consideration that condensate production does not immediately cease when the fluid-producing unit is shut off. If a float is not correctly oriented, deployment may be delayed or fail to occur, and the pump may not be activated in time before fluid overflows the secondary drain pan's vertically-extending walls. Such overflow generally leads to damage in the area around a secondary drain pan, which may involve a floor, walls, a ceiling, and/or fixtures associated therewith, as well as other items located nearby. In addition, false signaling may occur when floats are used, which causes pump activation when insufficient water is present, thereby damaging the pump. Thus, what is needed to provide a solution for all of the disadvantages noted above in the prior art, is a fluid level sensing unit for fluid-producing units or systems, which is durable for long-lasting and predictable use, has a reduced sensitivity to false signaling, does not require undue effort for accurate orientation, and can be relied upon to produce a signal after only a small amount fluid collects. These are all features provided by the present invention. Other desirable features and characteristics of the present invention will become apparent from the following invention description and its appended claims, as well as the accompanying drawings.

BRIEF SUMMARY OF THE INVENTION

It is the primary object of this invention to provide a water detection assembly that monitors a pre-established threshold fluid level considered safe in the primary drain line connected to an HVAC system or other condensate-producing unit, and then becomes activated when such threshold is exceeded as a result of a drain-blocking clog in the primary drain line. It is also an object of this invention to provide a water detection assembly that has a reduced sensitivity to false signaling. In addition, it is an object of this invention to provide a water detection assembly that is convenient to use and does not require undue installation effort to provide accurate positioning and/or orientation. It is also an object of this invention to provide a water detection assembly that can be relied upon to produce a signal after only a small amount fluid is collected. It is a further object of this invention to provide a water detection assembly with easily interchangeable components for expedited maintenance. It is also an object of this invention to provide a water detection assembly with all components having waterproof construction and connection. In addition, it is an object of this invention to provide a water detection assembly that is cost effective to manufacture and use.

The present invention, when properly made and used, provides a water detection assembly having an electronic fluid-sensing probe with in-line positioning inside the primary drain line connected to a fluid-producing unit. In-line positioning for the electronic fluid-sensing probe is achieved via connection to an access port, which is also used as a cleanout device for the drain line downstream from it, that can be used for easy and fast removal of clog-causing debris from the drain line. The access port has an internal configuration that creates a step-down fluid-collection area, whether it is installed a vertical or horizontal orientation according to the amount of space available or other application need. The water-detection probe is placed into a fixed position relative to this step-down fluid-collection area, out-of-the-way from normal fluid flow through the access port. It is only when a blockage occurs in the primary drain line that the step-down fluid-collection area begins to fill with fluid. Should the amount of fluid in the step-down area reach a level that would allow fluid to start moving through the upstream portion of the connected drain line toward the fluid producing unit, the rising fluid will come into contact with both of the power potentials in the fluid-sensing probe, thus causing activation of a connected signal-generating unit that promptly sends an electronic signal that shuts off fluid production, activates an alarm or pump, and/or provides remote notification. Anytime routine maintenance or other service is desired for the primary drain line downstream of the access port, one can easily and promptly unscrew the cap that is connected to the fluid-sensing probe, and use the cap to withdraw the fluid-sensing probe from its monitoring position adjacent to the step-down fluid-collection area. Then, through the opening in the access port where the fluid-sensing probe had been, chemicals can be introduced into the portion of the primary drain line downstream from the access port without any worry of retrograde backflow of the chemicals into the associated HVAC system or fluid-producing other unit. The present invention fluid-sensing probe and cap are connected through a longitudinal opening in the access port when the access port is vertically installed, and alternatively through a laterally positioned opening when the access port is horizontally installed. Since in its horizontal and vertical orientations fluid flow through the access port occurs in opposite directions, information markings on the outside of the access port are important to remind an installer of the needed direction of fluid flow through it to achieve a proper installation. Furthermore, the electronic fluid-sensing probe is without moving parts, which avoids the causes of failure common to pan-mounted water sensors having a deployable float, which include but are not limited to, inadequate leveling of the float body during installation relative to the pan wall supporting it, mounting to an insubstantial pan wall that leans-in over time, and the presence of mold, algae, and/or other interfering debris that accumulates over time on the movable float and prevents its proper deployment in response to rising fluid in the pan. Also, a quick-disconnect connection is placed between fluid-sensing probe and the signal-generating unit associated therewith, which allows the signal-generating unit to be separated from the fluid-sensing probe and used independently from the probe to monitor the pre-established threshold fluid level in a secondary drain pan. The signal-generating unit can be easily attached to the fluid-producing unit, a nearby wall, a secondary drain pan, or other support surface, via double-sided tape and/or fasteners. When the present invention probe is in its usable position adjacent to the step-down fluid-collection area and detects fluid, the fluid completes a circuit that causes the connected high amp signal-generating unit to send an electronic signal that shuts off fluid production, activates an alarm or pump, and/or provides remote notification to one or more locations. One of the two power potentials in the probe needed for signal generation has distal end positioning at a higher elevation above the step-down fluid-collecting area than the other, and extends through its false-trigger-reducing resilient piece in a position to wait for rising fluid without premature activation. The resilient piece has a partial cone-shaped structure, which provides a drip path to wick fluid away from the more highly elevated power potential. One of the two power potentials used may also have a circular configuration. The simple interior structure of the signal-generating unit lowers manufacturing cost, and since there is no deployable float involved, installation is simple and easy.

The description herein provides preferred embodiments of the present invention but should not be construed as limiting its scope. For example, variations in the thickness dimension of the material used to create the access port; the type of insulation used with the access port; the length, width and thickness dimensions of the quick-disconnect connector; the pattern of rotation-assisting projections on the cap; the configuration of electronic sensing probes used; the size and configuration of the exterior structure used to house internal electronic components of the signal-generating unit; the size and positioning of its test button and light; and the length dimensions of the electrical wiring used to place the fluid-sensing probe in communication with the signal-generating unit, other than those shown and described herein, may be incorporated into the present invention. Thus, the scope of the present invention should be determined by the appended claims and their legal equivalents, rather than being limited to the examples given.

BRIEF DESCRIPTION OF THE SEVERAL VIEWS OF THE DRAWINGS

In some of the following illustrations only those components that are pertinent to understanding the present invention may be shown and/or numbered. Identical numbering is given to identical or functionally similar elements throughout the separate figures, thereby attempting to illustrate the most preferred embodiment of the present invention while explaining various principles and advantages thereof. One reviewing the accompanying figures must understand that they are illustrated for simplicity and clarity, and have not necessarily been drawn to scale. Also, during review of the accompanying figures one must appreciate that the dimensions of some of the elements in them may be exaggerated (or minimized) where needed relative to other elements to help provide a better understanding of the present invention. However, in most instances, if such exaggeration is present, it will be noted.

COMPONENT LIST

Figure 1:
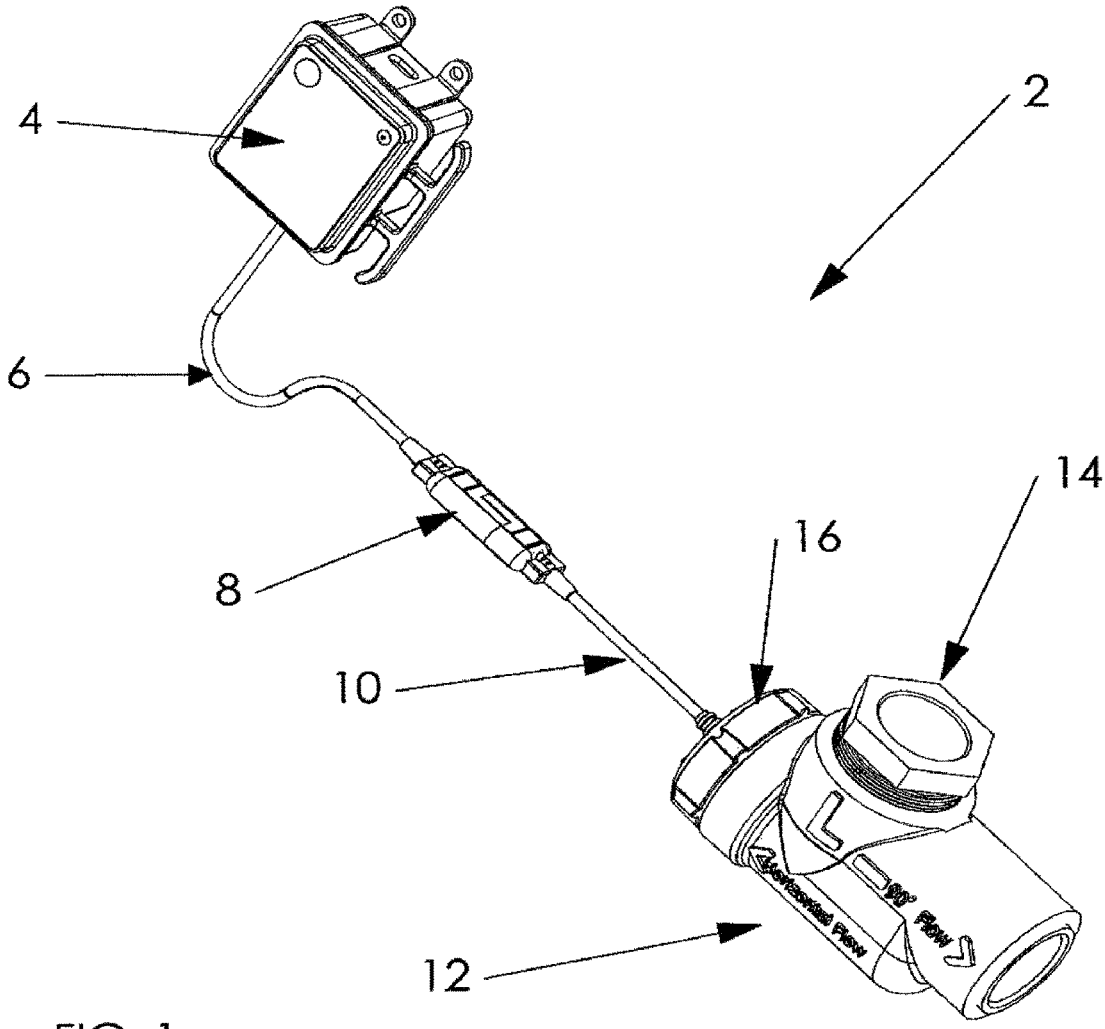
FIG. 1 is a perspective view of the most preferred embodiment of the present invention water detecting assembly having an electronic fluid-sensing probe connected to a signal-generating unit via a quick-disconnect connector, with the probe being inserted through a threaded cap into a longitudinal/end opening of an access port that is used for clearing and removing clog-causing debris, wherein during use the access port is connected in-line with a primary drain line associated with a heating, ventilating, and air conditioning (HVAC) system, or other system having a fluid-producing unit, with a substantially vertical orientation of the access port being contemplated and the direction of fluid flow needed away from a connected fluid-producing unit after access port installation in a primary drain line indicated by an arrow marked on the outside of the access port in broken lines and incorporating the words "90-degree flow".

2—complete invention assembly (signal-generating unit 4, quick-disconnect connector 8, electronic fluid-sensing probe used with cap 16, access port 12, and electrical wiring 6 and 10)
4—signal-generating unit
6—electrical wiring between 4 and 8
8—two-pin quick-disconnect connector
8A—first part of quick-disconnect connector 8
8B—second part of quick-disconnect connector 8 (which is identical to first part 8A)
10—electrical wiring between quick-disconnect connector 8 and the fluid-sensing probe connected to cap 16
12—access port for a primary drain line associated with a fluid-producing unit (also referred to herein as a cleanout unit, and two out of three of its openings are in fluid communication with a primary drain line, with the third of its three openings used for the insertion of an electronic fluid-sensing probe and alternatively to add chemicals and/or conduct other procedures to clean out the primary drain line, should it become clogged)
14—adapter with a central through-bore that becomes inserted within the opening with threads 38 in access port 12 that is not selected for engagement with cap 16 (PVC glue or other adhesive or bonding means can be used during installation of access port 12 to secure adapter 14 in the opening with threads 38 not used with cap 16)
16—cap used for introducing fluid-sensing probe into access port 12
18—mounting tabs with fastener holes on signal-generating unit 4
20—external support on signal-generating unit 4 for wrapping surplus length of electrical wiring 6
22—opening in the top of signal-generating unit 4
24—test light on signal-generating unit 4
26—test button on signal-generating unit 4
28—removable cover secured to the front of signal-generating unit 4

30—electrically conductive pin used as a part of quick-disconnect connector 8

32—over-molding extension used in both parts of quick-disconnect connector 8 to protect electrical wiring 6 and 10 and provide a waterproof seal between quick-disconnect connector 8 and electrical wiring 6 and 10

34—socket used as a part of quick-disconnect connector 8 to receive pin 30

36A—end of electrical wiring 6 shown without its protective sheathing

36—Bend of electrical wiring 10 shown without its protective sheathing

38—threads used for connection of cap 16 to a selected one of two adjacent openings in access port 12

40—information markings that include words relating to product identification, and arrows and words identifying needed direction of fluid flow after installation of access port 12

42—non-threaded end of access port 12 remotely positioned from the remaining two openings having threads 38, one of which is selected for connection to cap 16 according to the installed orientation of access port 12

44—false-trigger-reducing resilient piece that can be used as a part of the fluid-sensing probe

46—hexagonal tool-assisting collar of adapter 14

48—non-threaded stem of adapter 14 that is inserted into one of the openings in access port 12 having external threads 38 that is not selected for engagement with cap 16, and it is it is expected for bonding agents (not shown) to be used to secure stem 48 within such opening (52 or 56)

50—central through-bore in adapter 14 that provides fluid communication between access port 12 and the primary drain line (not shown) after access port 12 installation

52—lateral/side opening in access port 12

54—step-down fluid-collection area in access port 12

56—longitudingal/end opening in access port 12 (glued into the primary drain line, with connection to the downstream portion of the primary drain line when access port 12 is installed with a vertical orientation, and with alternative connection to the upstream portion of the primary drain line when access port 12 is installed with a horizontal orientation)

58—rotation-assisting projections 58 on the external portion of cap 16

60—protective over-molding associated with false-trigger-reducing resilient piece 44 that is used to protect wiring 10 as it extends through cap 16 and provide a waterproof seal between electrical wiring 10 and cap 16

62—non-circular power potential in the electronic fluid-sensing probe (two power potentials are needed for activation of signal-generating unit 4, and if both are non-circular, one should be shorter in length than the other to reduce false-triggering of signal-generating unit 4)

64—O-ring used in cap 16 to provide a waterproof seal between cap 16 and access port 12

66—extension depending from over-molding 60 and through which electrical wiring 10 is inserted after it extends through cap 16 and before ends 36A or 36B are separated for independent electrical connection to different electrical clips 68

68—electrical clip used to provide electrical communication between electrical wiring 10 and a non-circular power potential 62 or a circular power potential 70

70—circular power potential in the electronic fluid-sensing probe, one of two power potentials needed for activation of signal-generating unit 4

72—inner protective member for non-circular power potentials 62 used in the electronic water-sensing probe, which is positioned within false-trigger-reducing resilient piece 44 and assists in wicking moisture away from the shorter power potential 62

74—grip-enhancing rib on two-pin quick-disconnect connector 8

DETAILED DESCRIPTION OF THE INVENTION

Figure 2:
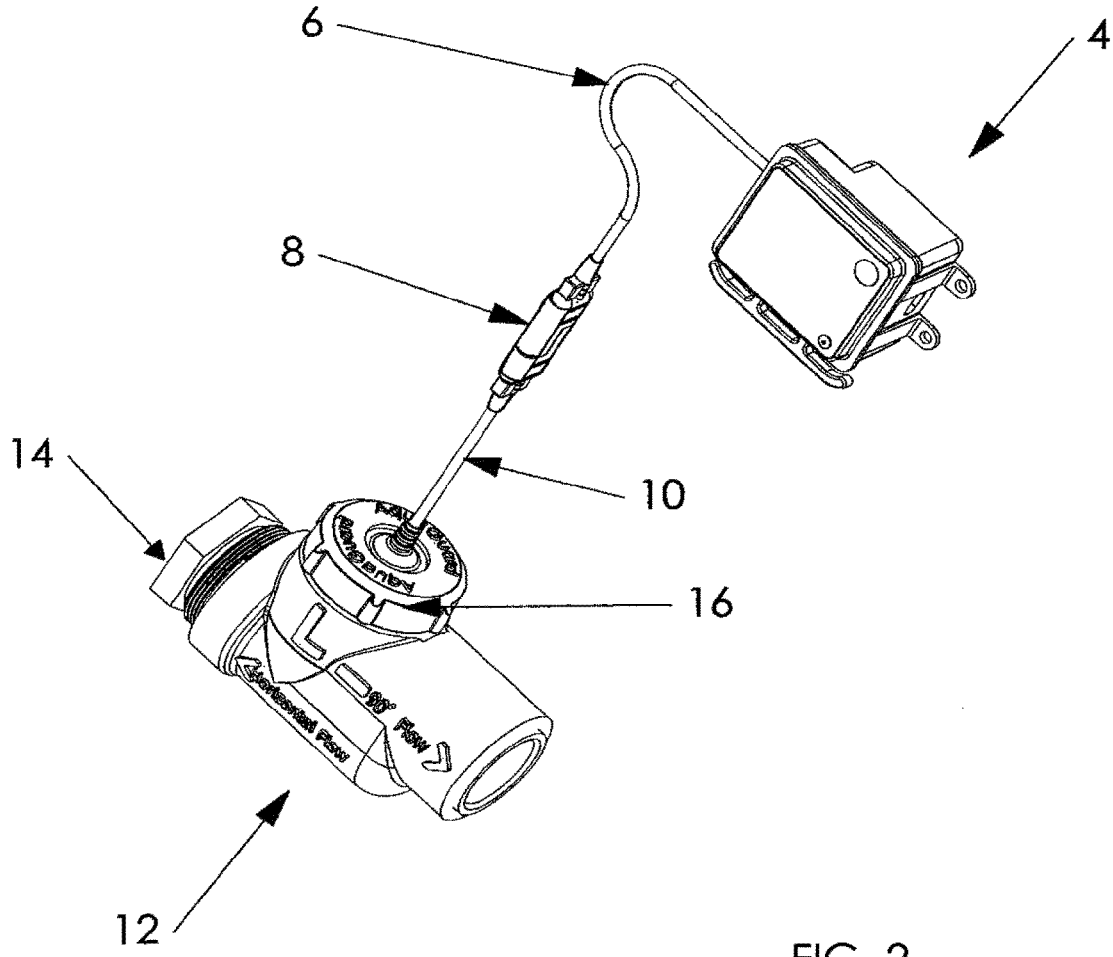
FIG. 2 is a perspective view of the most preferred embodiment of the present invention shown in FIG. 1, but with the probe being inserted through a threaded cap into a lateral/side opening in the access port and the orientation of the access port being substantially horizontal, wherein the direction of fluid flow needed away from a connected fluid-producing unit after access port installation in a primary drain line is in the opposite direction from that shown in FIG. 1 and marked on the outside of the access port by an arrow associated with the words "horizontal flow".
Figure 3:
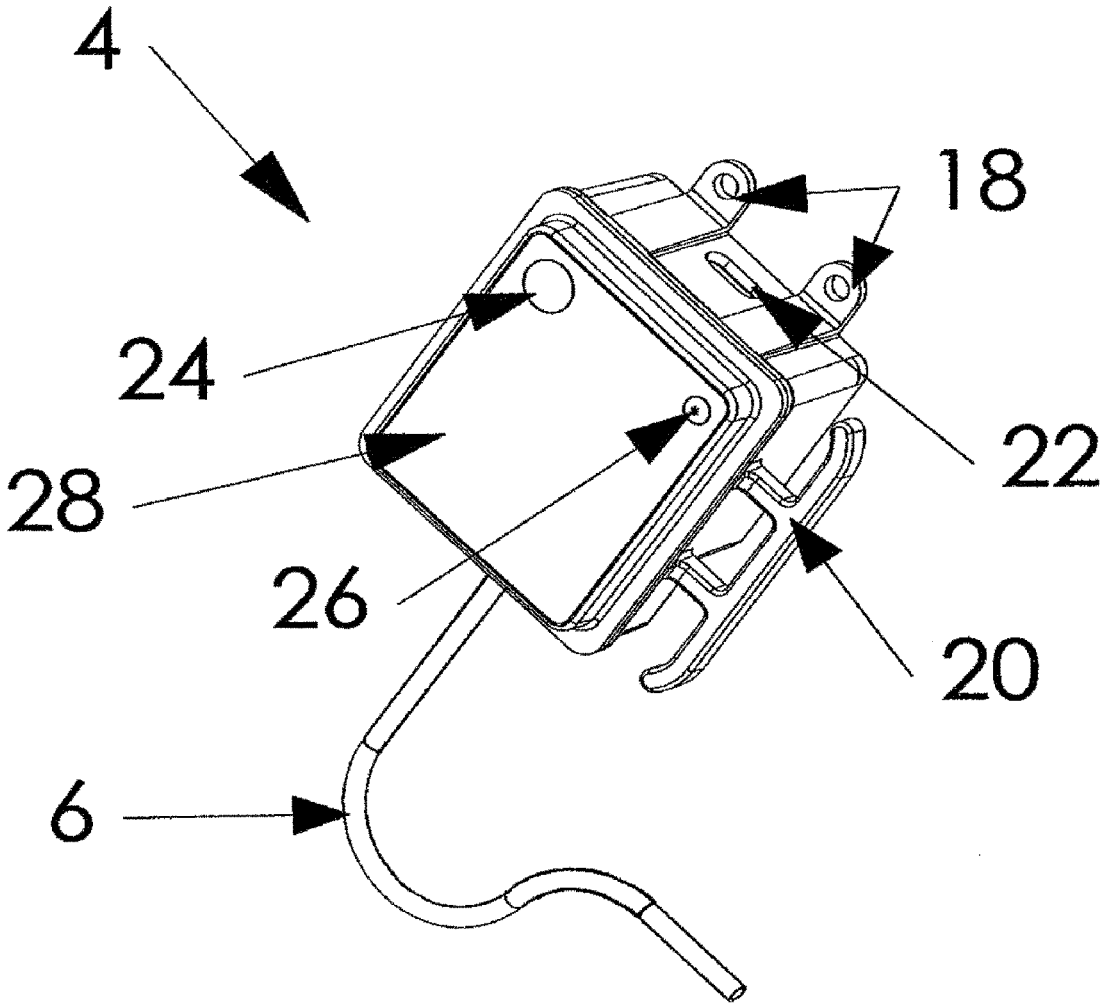
FIG. 3 is a perspective view of a signal-generating unit that can be used as a part of the most preferred embodiment of the present invention.
Figure 4:
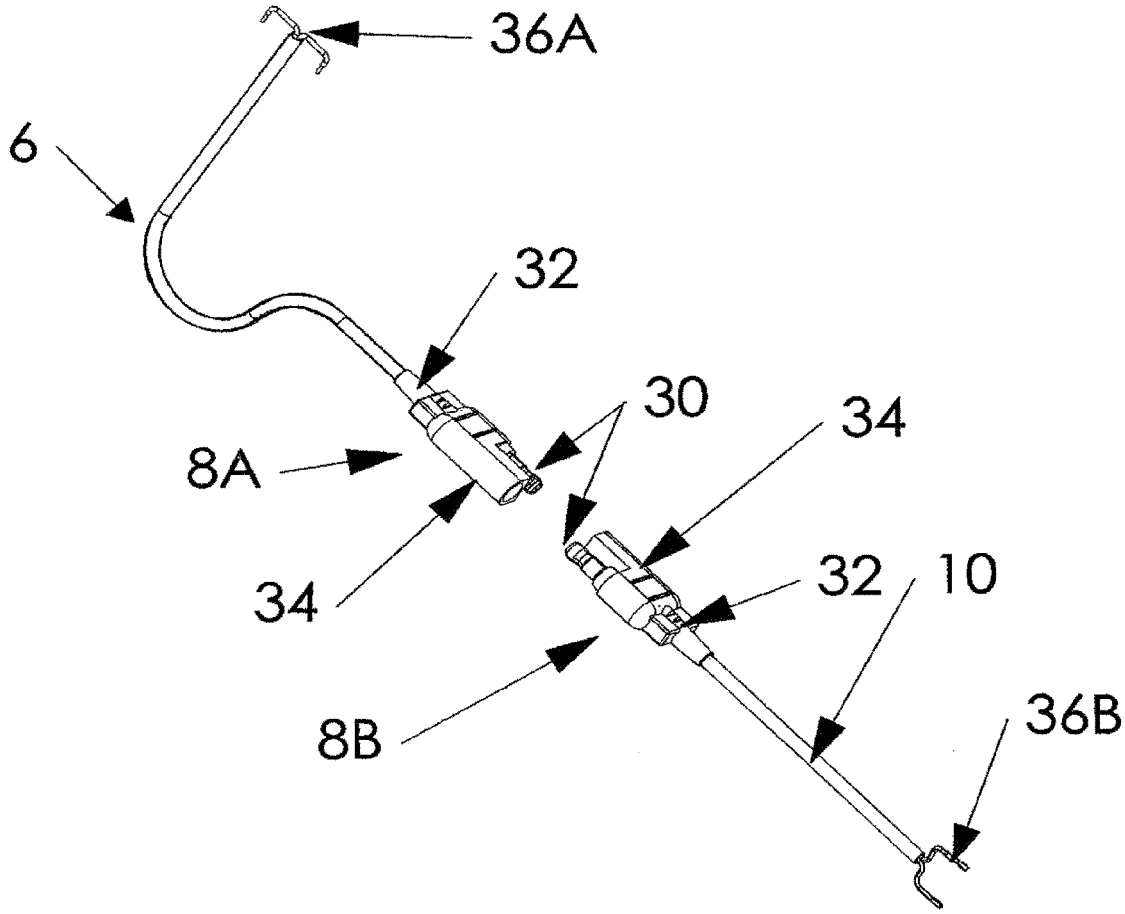
FIG. 4 is a perspective view of a two-member quick-disconnect connector that can be used as a part of the most preferred embodiment of the present invention.
Figure 5:
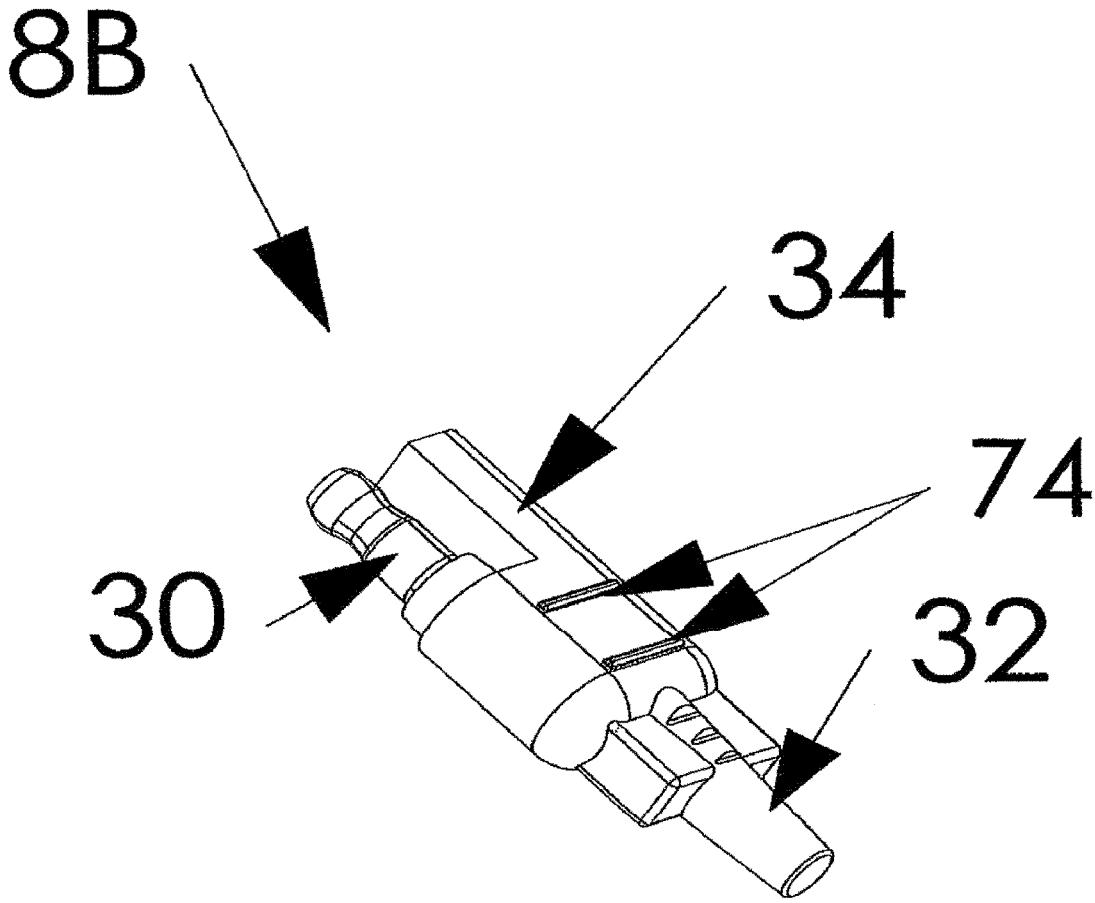
FIG. 5 is a perspective view of one quick-disconnect connector member without attached electrical wiring that can be used as a part of the most preferred embodiment of the present invention.
Figure 6:
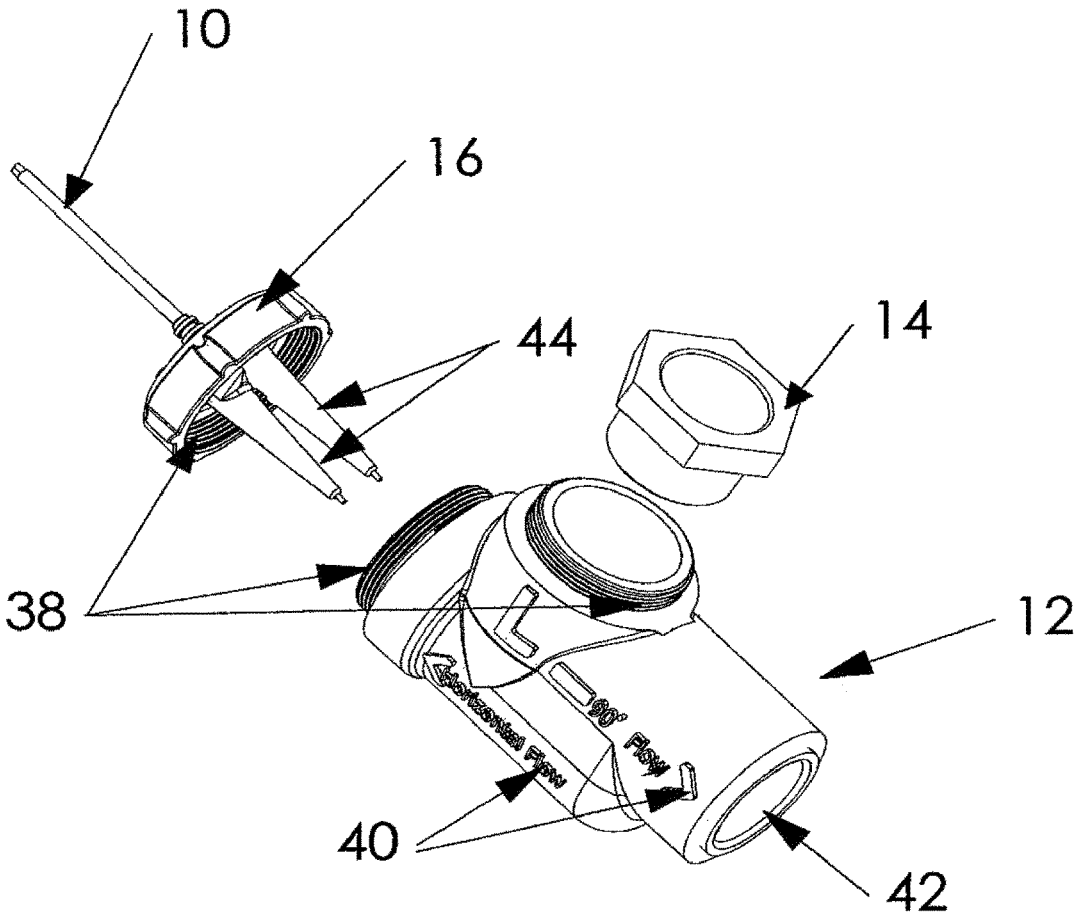
FIG. 6 is an exploded view of the electronic fluid-sensing probe, access port, and adapter that can be used as a part of the most preferred embodiment of the present invention.
Figure 7:
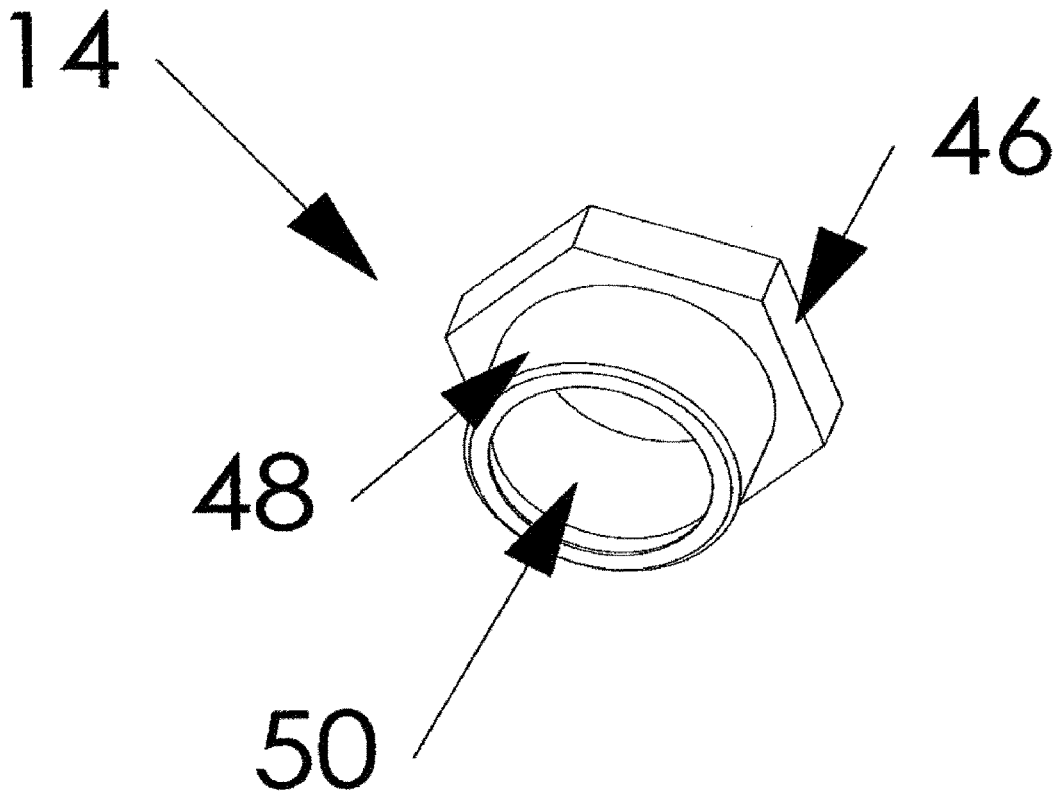
FIG. 7 is an enlarged view of the adapter shown in FIG. 6.

The following description of the most preferred embodiment of the present invention is merely exemplary in nature and is not intended to limit the invention's structure, function, or application. However, with that said, the present invention provides a fluid detection assembly 2 having an electronic fluid-sensing probe attached to a cap 16 for connection to an access port 12 that will give it in-line positioning inside a primary drain line (not shown) connected to a fluid-producing unit (not shown). When the electronic fluid-sensing probe and cap 16 are removed from access port 12, the opening into which they are received during fluid monitoring use can be used to introduce chemicals for cleaning or maintenance purposes into the downstream portion of the primary drain line with which it is connected. The unique design of the access port 12 housing provides an internal step-down fluid-collection area 54 having an elevation lower than the bottom inside surface of the connected primary drain line segment located upstream of the access port, whether access port 12 is installed in a vertical or horizontal orientation. The fluid-sensing probe attached to cap 16 is placed into a fixed position adjacent to this step-down fluid-collection area 54, out of the normal flow of fluid from the connected fluid-producing unit traveling in the upstream portion of the primary drain line, through access port 12 connected in-line therewith, and further downstream in the primary drain line. It is only when a blockage occurs that the step-down fluid-collection area 54 begins to fill with fluid, and when the amount of fluid in the step-down area 54 reaches a threshold amount no longer considered safe (with backflow into portion of the primary drain line leading to the fluid-producing unit imminently possible), the fluid will come into contact with both of the power potentials (62 and/or 70) in the probe connected to cap 16, thus causing activation of a connected signal-generating unit 4 that promptly sends an electronic signal to shut off fluid production, activate an alarm or pump, and/or provide remote notification, before rising fluid is able to move out of the step-down fluid-collection area 54 toward the fluid-producing unit and place it at risk for damage. The unique design of access port 12 also allows for removal of the fluid-sensing probe and its cap 16 therefrom, and introduction of chemicals into the downstream portion of the primary drain line connected to the access port 12, without any worry of retrograde backflow of the chemicals into the associated HVAC system or fluid-producing other unit. The present invention fluid-sensing probe is sealed within access port 12 using a longitudinal opening 56 when access port 12 is vertically installed, and in the alternative, through a laterally positioned opening 52 when access port 12 is horizontally installed. In its horizontal and vertical orientations, fluid flow through access port 12 occurs in opposite directions. Therefore, information markings 40 on the outside surface of access port 12 (or on any insulation wrapped around it) are important to remind an installer of the needed direction of fluid flow through it to achieve a proper installation. Furthermore, the electronic fluid-sensing probe of the present invention that is connected to cap 16 preferably has a quick-disconnect connection (via connector 8) to the signal-generating unit 4 and is without moving parts, which avoids the causes of failure common to prior art pan-mounted water sensors having a deployable float, which include but are not limited to, inadequate leveling of the float body during installation relative to the pan wall supporting it, mounting to an insubstantial pan wall that leans-in over time, and the presence of mold, algae, and/or other interfering debris that accumulates over time on the movable float and prevents its proper deployment in response to rising fluid in the pan. When the present invention fluid-sensing probe and its connected cap 16 are in their usable positions and the probe's power potentials (62 and/or 70) in their positions next to the step-down fluid-collection area 54 detect the presence of fluid, the fluid contacting the power potentials 62 and/or 70 completes a circuit that causes the connected signal-generating unit 4 to send an electronic signal that shuts off fluid production, activates an alarm or pump, and/or provides remote notification to one or more locations. One of the two power potentials (62 or 70) in the probe needed for signal generation has distal end positioning at a higher elevation than the other, and extends through its false-trigger-reducing resilient piece 44 in a position to wait for rising fluid, without premature activation. The resilient piece 44 may have opposing ends and a cone associated with each opposing end, one of which provides a drip path to wick fluid away from the more highly elevated power potential. One of the two power potentials used may also have a circular configuration 70. In addition, although not shown, the signal-generating unit 4 electrically connected to the fluid-sensing probe via two-part quick-disconnect member 8 is preferably fixed in position and may be attached to the associated fluid-producing unit, a nearby wall, a secondary drain pan, or other support surface, via double-sided tape and/or fasteners. FIGS. 1 and 2 respectively show an assembled present invention fluid detection assembly with cap 16 connected to access port 12 for vertical installation and horizontal installation. FIG. 3 shows an enlargement of a preferred present invention signal-generating unit 4, while FIGS. 4 and 5 show more detail about a preferred quick-disconnect connector 8 that can be used as a part of the present invention. FIGS. 6-8 show present invention components associated with access port 12, while FIGS. 9-14 show more detail about two alternative embodiments of fluid-sensing probe and their power potentials 62 and 70 that can be used as a part of the present invention.

FIGS. 1 and 2 respectively show preferred embodiment of the entire present invention water detection assembly 2 as it would appear to an observer when ready for installation. FIG. 1 shows access port 12 assembled with cap 16 and a fluid-sensing probe attached thereto for vertical installation, while FIG. 2 shows access port 12 assembled with cap 16 and a fluid-sensing probe attached thereto for horizontal installation. FIG. 1 is a perspective view of the most preferred embodiment of the present invention water detecting assembly 2 having an electronic water detection probe (hidden in FIG. 1 due to positioning within access port 12) that is connected to a signal-generating unit 4 via a two-part quick-disconnect connector 8, with the threaded cap 16 and its attached probe being connected to the threaded longitudinal/end opening 56 of access port 12 that can also be used for clearing and removing clog-causing debris when threaded cap 16 and its attached probe are separated from longitudinal/end opening 56, wherein during use the access port 12 is located in-line on a primary drain line (not shown) associated with a heating, ventilating, and air conditioning (HVAC) system (not shown), or other system having a fluid-producing unit, with a substantially vertical orientation of the access port 12 being contemplated and the direction of fluid flow needed away from a connected fluid-producing unit after access port 12 is installed in a primary drain line indicated by information markings 40 that include an arrow marked on the outside of the access port 12 in broken lines and incorporating the words "90-degree flow" as a part of the arrow's shaft. In contrast, FIG. 2 is a perspective view of the most preferred embodiment of the present invention shown in FIG. 1, but with the fluid-sensing probe being inserted through a threaded cap 16 into a lateral/side opening 52 in access port 12 and the orientation of access port 12 being substantially horizontal, wherein the direction of fluid flow needed away from a connected fluid-producing unit after access port 12 installation in a primary drain line is in the opposite direction from that shown in FIG. 1 and marked on the outside of access port 12 by information markings 40 that include an arrowhead associated with the words "horizontal flow" that appear behind the arrowhead as the arrow's shaft. The signal-generating unit 4 shown in FIGS. 1 and 2 (and as can also be seen in FIG. 3) has mounting tabs 18 with fastener holes that allow its positioning secured to a nearby wall. In the alternative, although not shown, double-sided tape may be attached to the back of signal-generating unit 4 for mounting to a nearby wall, or elsewhere. A test light 26 and depressible button 24 (or in the alternative test light 24 and depressible button 26) can be used to confirm proper function of signal-generating unit 4 anytime after its installation. The support 20 attached to signal-generating unit 4 can be used for wrapping surplus length of electrical wiring 6 so that it can be maintained in an out-of-the-way position.

FIGS. 1 and 2 also show a two-member waterproof quick-disconnect connector 8 that can be used as a part of the most preferred embodiment of the present invention connected between signal-generating unit 4 and access port 12 via electrical wiring 6 and 10, and cap 16. The most preferred pin-and-socket connector 8 has two elongated members (8A and 8B) each with opposing ends, a male contact or pin 30 adjacent to a socket 34 in side-to-side array at a first of said opposing ends, over-molding around the side-to-side pin 30 and socket 34 combination, the over-molding around the base of pin 30 having a tapered boss, the over-molding extension around the distal end of socket 34 configured for snugly receiving the tapered boss of its paired member to create a waterproof connection, two sheathed insulated wires within wiring 6 and 10 connected to pin 30 and socket 34, and the over-molding also having on its second end a strain-relief extension 32 positioned around the electrical wiring 6 and 10 as they enter the over-molding around each paired pin 30 and socket 34 in side-by-side array. Multiple ribs 74 on the over-molding below the opening to socket 34 enhanced the grip for forcing elongated members (8A and 8B) together, so as to provide a waterproof connection therebetween, and for pulling elongated members (8A and 8B) apart, when needed. Access port 12 is also shown in FIGS. 1 and 2, with cap 16 and adapter 14 having reversed positioning relative to access port 12. The fluid-sensing probe connected to cap 16 is hidden from view in FIGS. 1 and 2. Cap 17 has threads 38 for its connection to access port 12, and an O-ring 64 (or other reliable sealing means) would be used to make its connection to access port 12 waterproof. In contrast, although not shown, adapter 14 is connected between the primary drain line and access port 12 via glue, adhesive, and/or other bonding materials. Also shown in FIGS. 1 and 2 are the information markings 40 on access port 12 that help remind installers that the connection of the non-threaded end 42 of access port 12 to the primary drain line (not shown) is downstream in vertical orientations of access port 12, and reversed to have upstream connection to the primary drain line in horizontal installations. Although not shown in FIGS. 1 and 2, access port 12 has an internal configuration with a step-down fluid collecting area 54, which is monitored by the fluid-sensing probe connected to cap 16. During routine flow of fluid through access port 12, step-down fluid collecting area 54 has no fluid therein, and the fluid-sensing probe connected to cap 16 remains dry. It is only when a blockage occurs downstream of access port 12 in the primary drain line that the step-down fluid-collection area 54 begins to fill with fluid, and when the amount of fluid in the step-down area 54 reaches a threshold amount no longer considered safe, it will come into contact with both of the power potentials (62 and/or 70) in the probe, thus causing activation of a connected signal-generating unit 4 that promptly sends an electronic signal to shut off fluid production, activate an alarm or pump, and/or provide remote notification, before rising fluid is able to move out of the step-down fluid-collection area 54 toward the fluid-producing unit and place it at risk for damage. The unique design of the access port 12 also allows for removal of the fluid-sensing probe and cap 16, and introduction of chemicals into the drain line without any worry of retrograde backflow of the chemicals into the associated HVAC system or fluid-producing other unit.

FIG. 3 is a perspective view of a signal-producing member that can be used as a part of the most preferred embodiment of the present invention. FIG. 3 shows signal-generating unit 4 with two mounting tabs 18 each having a fastener hole that allows secure positioning of signal-generating unit 4 to a nearby wall or other surface. In the alternative, although not shown, double-sided tape may be attached to the back of signal-generating unit 4 for mounting to a nearby wall, or elsewhere. A test light 26 and depressible button 24 (or in the alternative test light 24 and depressible button 26) can be used to confirm proper function of signal-generating unit 4 anytime after its installation. Test light 26, preferably is a light-emitting diode (LED), and provides a visual status of the operational condition of signal-producing member 4 by lighting up when current is flowing through it. Also, the support 20 attached to signal-generating unit 4 can be used for wrapping surplus length of electrical wiring 6 to adjust its proper length to accommodate the application. FIG. 3 also shows a top opening 22 in signal-generating unit 4, which is used to connect a signal output wire (not shown) employed for sending a generated signal to shut off fluid production, activate an alarm or pump, and/or provide remote notification, before rising fluid in access port 12 is able to move out of the step-down fluid-collection area 54 in access port 12 toward the fluid-producing unit and place it at risk for damage. A separable cover 28 is further secured to the front of signal-generating unit 4, which seals a front opening through which internal electronic parts used for signal generation are secured. Electrical communication between the internal electronic parts in signal generating member 4 and the fluid-sensing probe installed within access port 12 is provided by the electrical wiring 6 shown in FIG. 3 extending from the bottom portion of signal-generating unit 4. Although not shown, an audible alarm may also be associated with signal-generating unit 4. Design considerations relating to the size and shape of signal-generating unit 4 should include cost-efficient objectives and space limitations at common installation sites. The configuration of wire wrapping support 20 is also not limited to that shown in FIG. 3, and its design considerations should also be guided by cost-efficient objectives and space limitations shared by common installation sites. In addition, the amount and configuration of material around the holes in mounting tabs 18 is not critical, although material without sharp corners is preferred. Although not shown, it is contemplated for signal-generating unit 4 to contain a printed circuit board, and at least one O-ring to seal the connection of cover 28 to the remainder of signal-generating unit 4. Cover 28 may also be secured against the remainder of signal-generating unit 4 via snap-fit connection, or other means.

FIG. 4 is a perspective view of a two-member waterproof quick-disconnect connector 8 that can be used as a part of the most preferred embodiment of the present invention for secure connection of electrical wiring 6 and 10 to one another in series, for reliable communication between the fluid-sensing probe connected to cap 16 and signal-generating unit 4. The most preferred pin-and-socket connector 8 has two elongated members (8A and 8B) identical in configuration, each with opposing ends, a male contact or pin 30 adjacent to a socket 34 in side-to-side array at a first of said opposing ends, over-molding 32 around the side-to-side pin 30 and socket 34, the over-molding 32 around the base of the pin 30 having a tapered boss, the over-molding extension around the distal end of socket 34 configured for snugly receiving the tapered boss of its paired member to create a waterproof connection, two sheathed insulated wires within wiring 6 and 10 connected to pin 30 and socket 34, and the over-molding also having on its second end a strain-relief extension 32 positioned around the electrical wiring 6 and 10 as they enter the over-molding around each paired pin 30 and socket 34 in side-by-side array. FIG. 5 is a perspective view of one quick-disconnect connector member marked as 8B, however it could also represent 8A. Electrical wiring 6 and 10 are not shown in FIG. 5. FIG. 5 shows several ribs 74 on the exterior surface of over-molding 4, and a strain-relief extension 32 depending from the over-molding around a paired pin 30 and socket 34 and configured for positioning around sheathed electrical wiring 6 or 10 as it enters the over-molding for connection to pin 30 and socket 34. The materials used for the over-molding around a paired pin 30 and socket 34 and an associated strain relief extension 32, may be the same or different. Socket 34 is totally positioned within the over-molding, while pin 30 partially extends from it. Although not shown in FIGS. 4 and 5, a socket 34 would be formed by a hidden female electrical contact totally positioned within the over-molding and a straight wall extension leading therefrom to the open distal end of female contact 18. Sheathed electrical wiring 6 and 10 would each comprise two insulated electrical wires (the unsheathed ends of which are shown in FIG. 4 as 36A and 36B) Once within the over-molding, one of the two electrical wires in 36 A or 36 B would be placed in electrical communication with socket 34, and the other one of the two electrical wires in 36 A or 36 B would be placed in electrical communication with pin 30. Socket 34 would remain separate from pin 34, and they would not touch. Although not clearly shown in the accompanying illustrations, pin 30 may be hollow and have a non-uniform distal end configuration that includes a narrowing tip, which at its largest diameter dimension is manufactured to be slightly larger than the inside diameter dimension of the socket 34 into which it will be inserted, so that the force of insertion provides friction resistance that will prevents withdrawal of pin 30 until deliberate outside separation force is applied to ribs 74 and other portions of the over-molding around pin 30 and socket 34. The tapered boss also pushes the straight wall bore at the end of socket 34 in an outwardly direction to create an enhanced waterproof connection and seal around pin 30 and its associated socket 34. Ribs 10 allow opposed connective members to be pressed completely together, while the tapered boss allows for low insertion forces and larger manufacturing tolerances. The larger manufacturing tolerances provide more favorable manufacturing cost, and low insertion forces aid installers in pressing paired elongated connective members completely together during the long-term use, years at a time, that is needed in fluid-overflow monitoring functions related to HVAC applications. Plastics are one contemplated material for the over-molding around socket 34 and pin 30, the ribs 10, and the strain relief extensions 32, but not limited thereto.

Figure 8A:
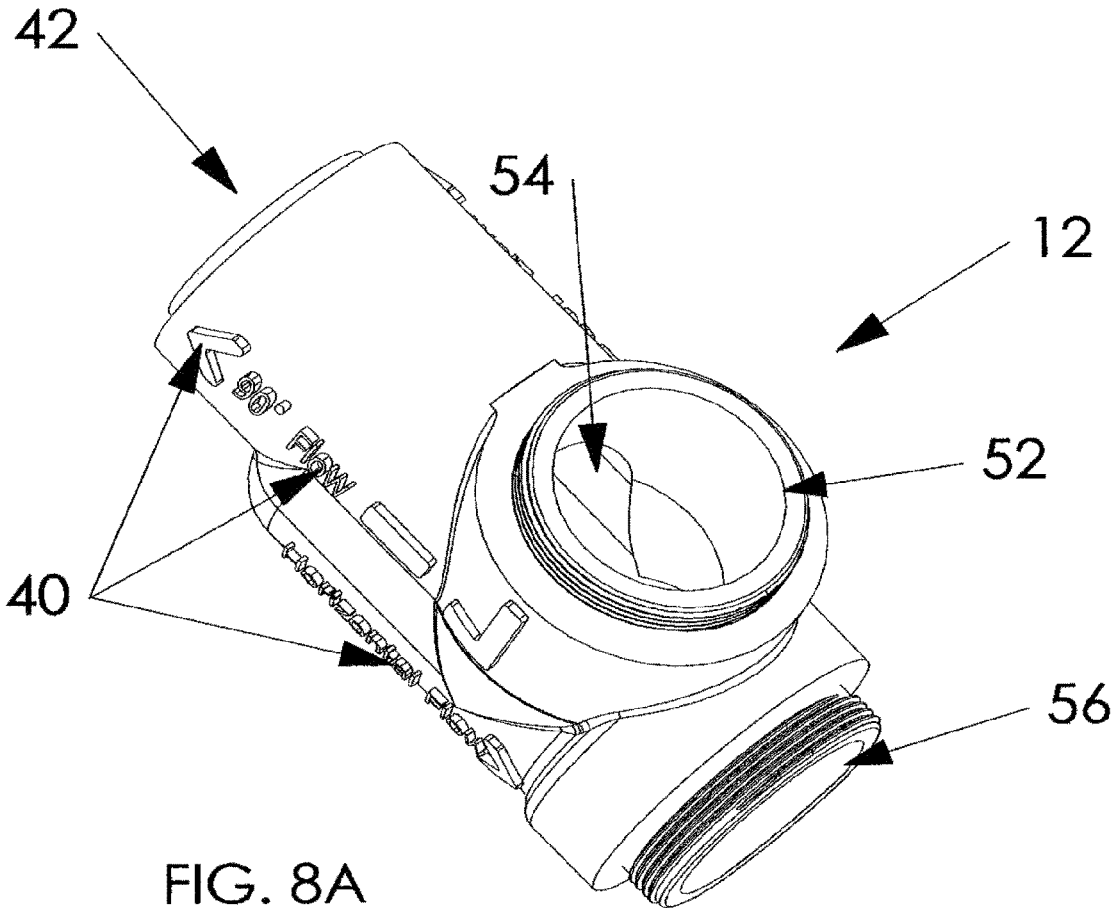
FIG. 8A is a perspective view of the access port shown in FIG. 6 and showing the internal step-down fluid-collecting area.
Figure 8B:
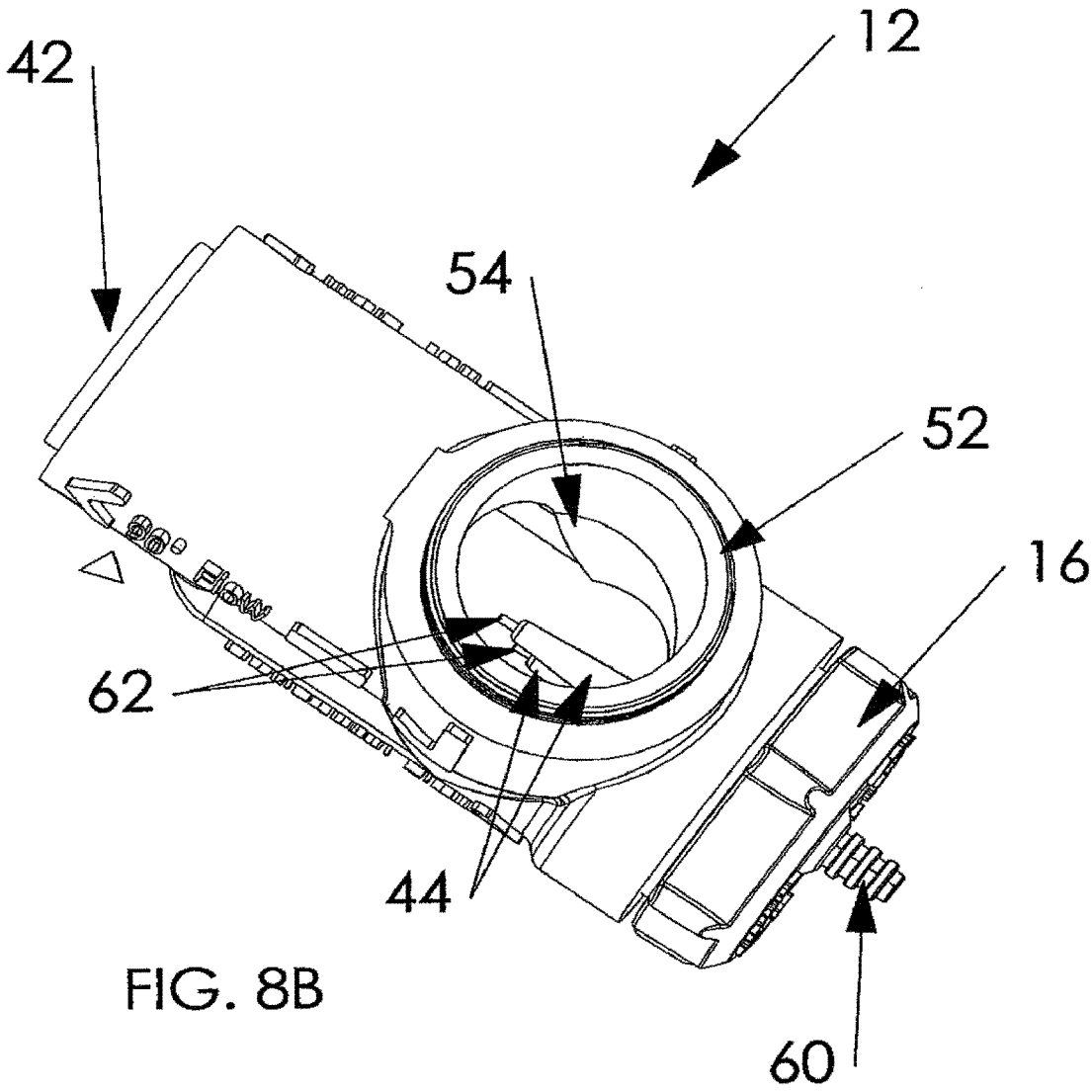
FIG. 8B is a perspective view of the access port shown in FIG. 6 and showing preferred positioning of the fluid-sensing probe relative to the internal step-down fluid-collecting area.

FIGS. 6, 7, 8A, and 8B show present invention components associated with access port 12. FIG. 6 is an exploded view of the electronic fluid-sensing probe secured to cap 16, access port 12, and adapter 14 that can be used as a part of the most preferred embodiment of the present invention to secure the non-threaded end of access port 12 to a portion of the primary drain line. FIG. 7 is an enlarged view of the adapter 14, while FIGS. 8A and 8B are perspective views of access port 12 with cap 16 and adapter 14 removed, and also oriented so that some of the step-down fluid-collecting area 54 within access port 12 is visible, with FIG. 8B showing the fluid-sensing probe preferred positioning relative to step-down fluid-collecting are 54. In FIGS. 6 and 8A, one can see that the end of access port 12 having threads 38 is wider than its non-threaded end 42, which provides the internal space to accommodate step-down fluid-collecting area 54. As can also be seen in FIG. 9 and marked with numerical designation, cap 16 is shown to have rotation-assisting projections 58 that removal of cap 16 and tight, waterproof connection thereof over openings 52 and 56 in access port 12. Using rotation-assisting projections 58 on cap 16 in all present invention embodiments is non-critical, but preferred. Also, the configuration of rotation-assisting projections 58 may vary from that shown without departing from the scope of the present invention. FIGS. 6 and 8A also show preferred information markings 40 on the external surface of access port 12 that indicate the direction of fluid flow through access port 12 to avoid installer confusion, as both horizontal and vertical installed orientations are contemplated for the present invention access port 12 which require opposite ends of access port 12 to be connected to the upstream portion of a primary drain line. If the proper end of access port 12 is not connected according to the needed installation, fluid flow into the step-down fluid-collecting area 54 will be bypassed should a blockage in the downstream portion of the primary drain line occur. FIGS. 1, 6 and 8B show access port 12 with cap 16 connected for vertical installation where the downstream portion of the primary drain line connected to access port 12 is in a substantially vertically-extending orientation, and fluid flow through access port 12 occurs according to the information marking 40 having the words "90-degree flow" as a part of the shaft of an arrow. In contrast, FIG. 2 shows access port 12 with cap 16 connected for horizontal installation where the downstream portion of the primary drain line connected to access port 12 is in a substantially horizontally-extending orientation, and fluid flow through access port 12 occurs according to the information marking 40 having the words "horizontal flow" as the shaft of an arrow. Furthermore, FIGS. 1, 2, 6, and 6 show an adapter 14 with a hexagonal tool-assisting collar 46 that can be used with bonding agents to secure a selected one of the threaded openings 52 or 56 to the primary drain line. However, it is also contemplated for common plumbing connections to also be used for such connection of threaded openings 52 and 56. FIG. 7 shows the preferred hexagonal tool-assisting collar 46 of adapter 14, the central through-bore 50 in adapter 14 that provides fluid communication between access port 12 and the primary drain line (not shown), and the smooth stem 48 of adapter 14 that would receive bonding agents (not shown) to create a tight, waterproof seal with the internal non-threaded surface of externally threaded openings 52 and 56. For routine maintenance in the primary drain line connected to access port 12, cleaning agents may need to be periodically added to prevent the formation of algae, mold, and other substances that could grow and turn into fluid-blocking clogs in the portion of the primary drain line downstream from access port 12. The presence of step-down fluid-collecting area 54 allows for the removal of cap 16 and its attached fluid-sensing probe from access port 12, and subsequent introduction of chemicals through the opening (52 or 56) to which cap 16 had been attached, without backflow migration of chemicals into the upstream portion of a connected primary drain line that is in a horizontally-extending orientation. Introduction of chemicals also occurs without air-lock malfunction, and often without the need of a funnel, and in vertical orientations of access port 12 the step-down fluid-collecting area 54 facilitates splash-free downward flow of cleaning agents added through opening 56. The presence or absence of information markings 40 on the outside surface of cap 16 (as shown in FIG. 10) is not critical. Also, although the exterior surfaces of access port 12 are shown in to be generally unadorned, with the exception of information markings 40, they may have any surface texture or other markings that do not interfere with the intended application. The configuration of adapter 14 is not limited to that shown, and it may have any configuration appropriate to the waterproof connection of access port 12 to a primary drain line (not shown). Furthermore, the relative dimensions shown for access port 12 can be varied from that shown in the accompanying illustrations herein, as long as each is sufficiently large to fulfill its intended function without undue material waste.

Figure 9:
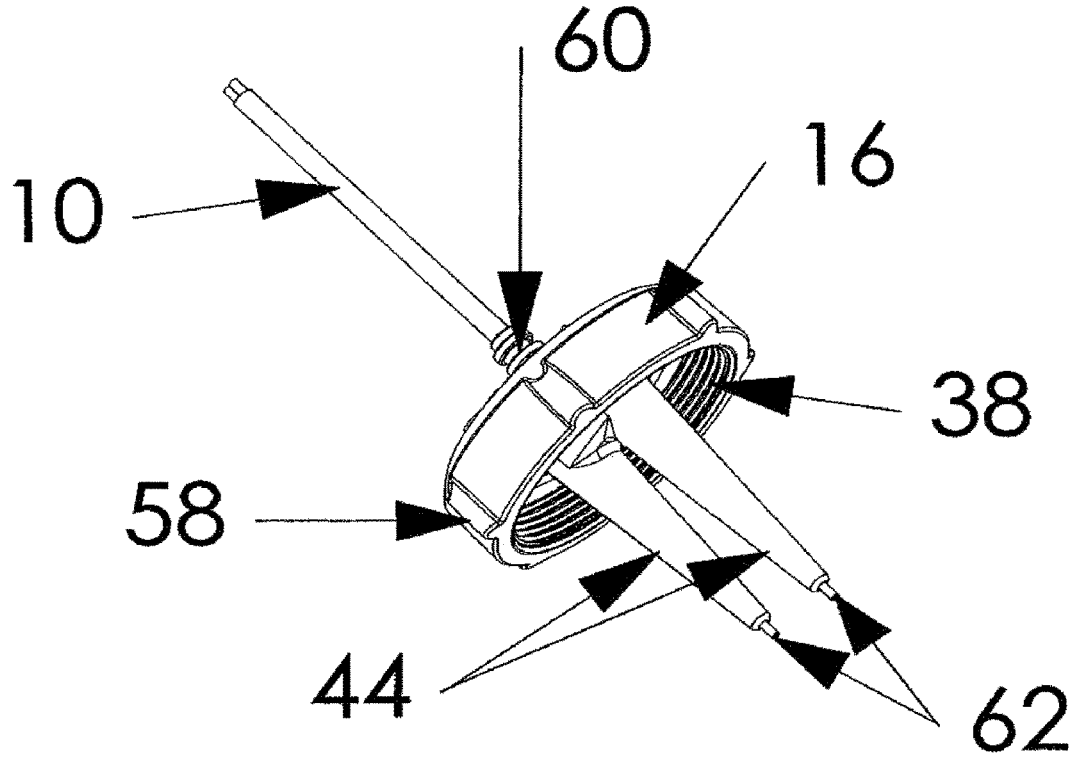
FIG. 9 is a perspective view of the electronic fluid-sensing probe shown in FIG. 6.
Figure 10:
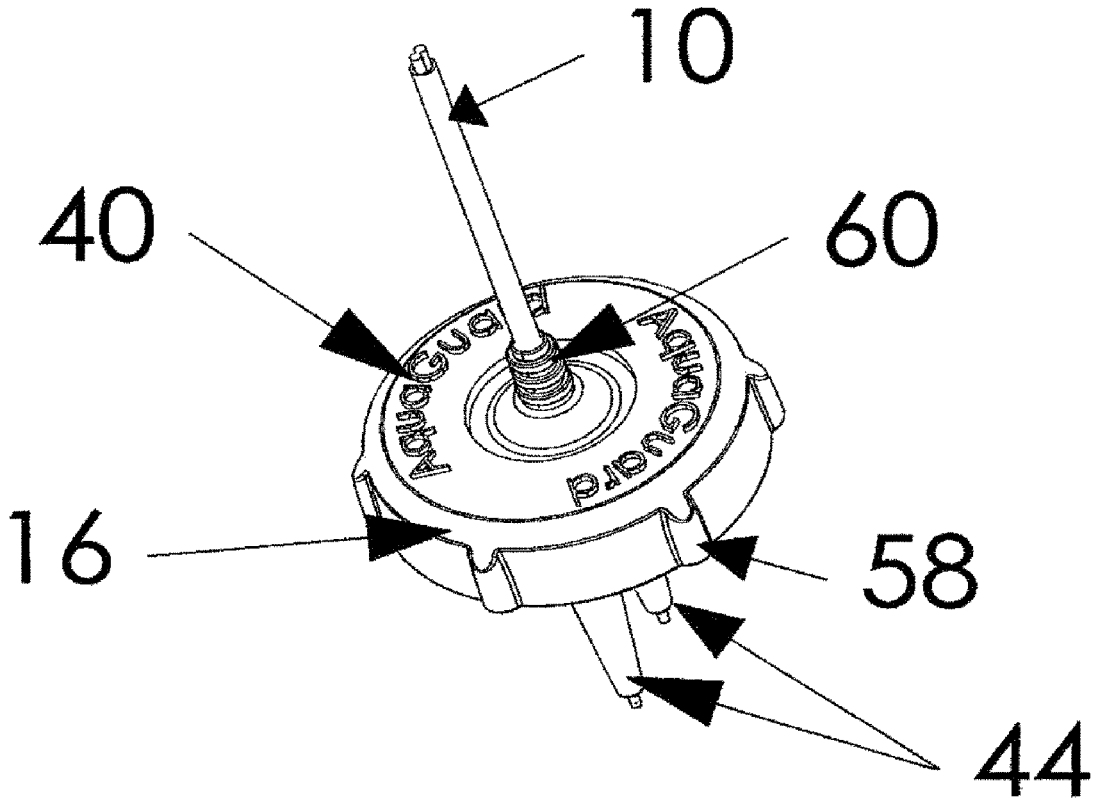
FIG. 10 is a top view of the probe shown in FIG. 9.
Figure 11:
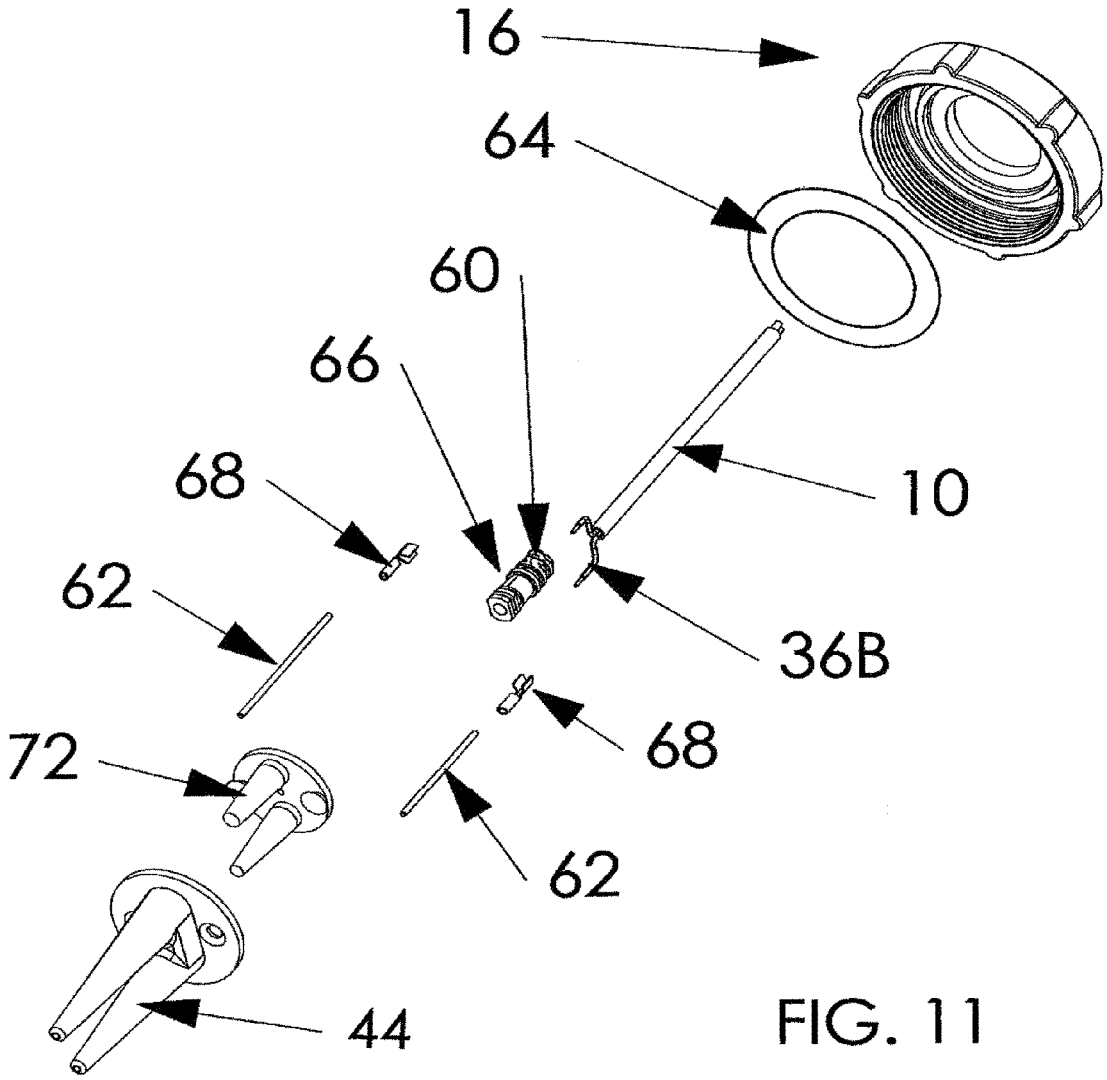
FIG. 11 is an exploded view of the probe shown in FIG. 9.
Figure 12:
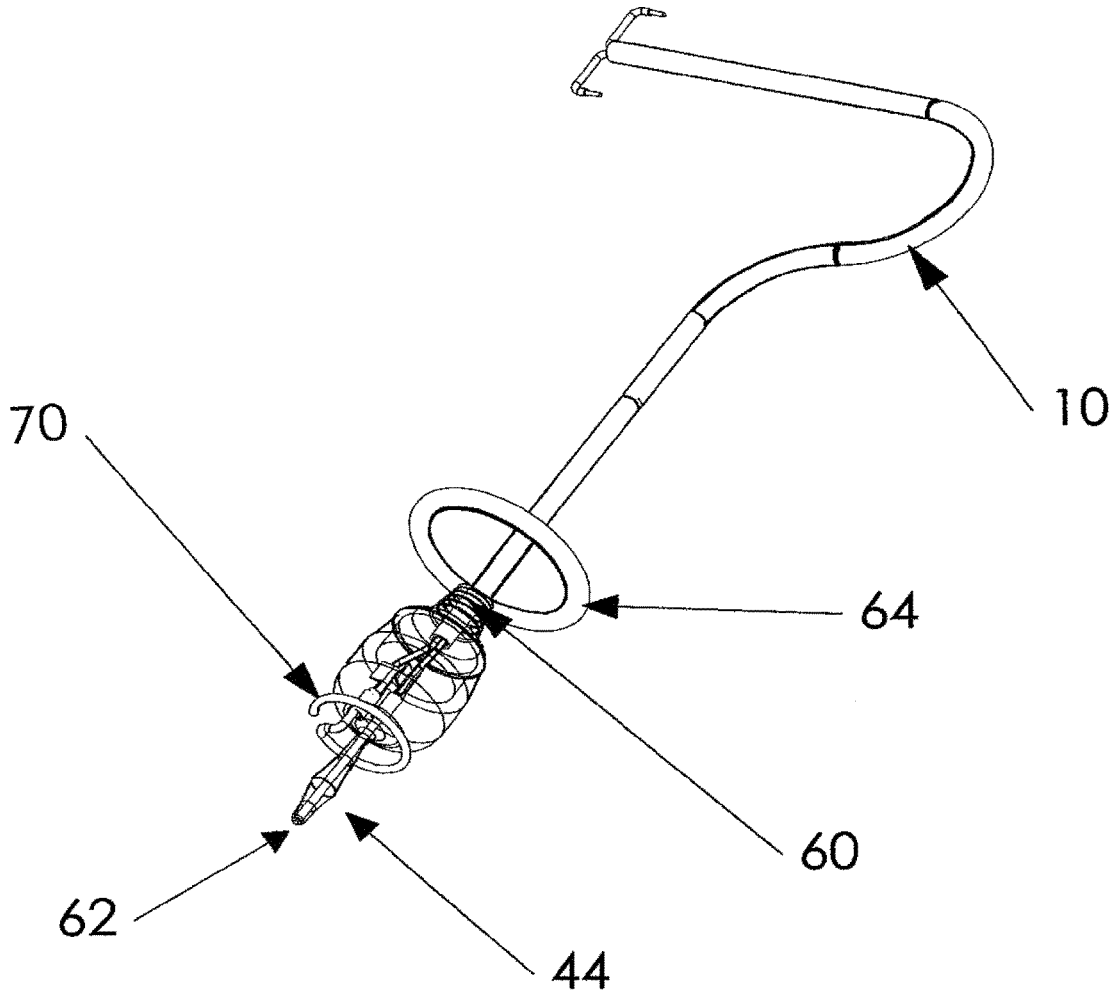
FIG. 12 is an exploded view of a second electronic fluid-sensing probe that can be used in preferred embodiments of the present invention.
Figure 13:
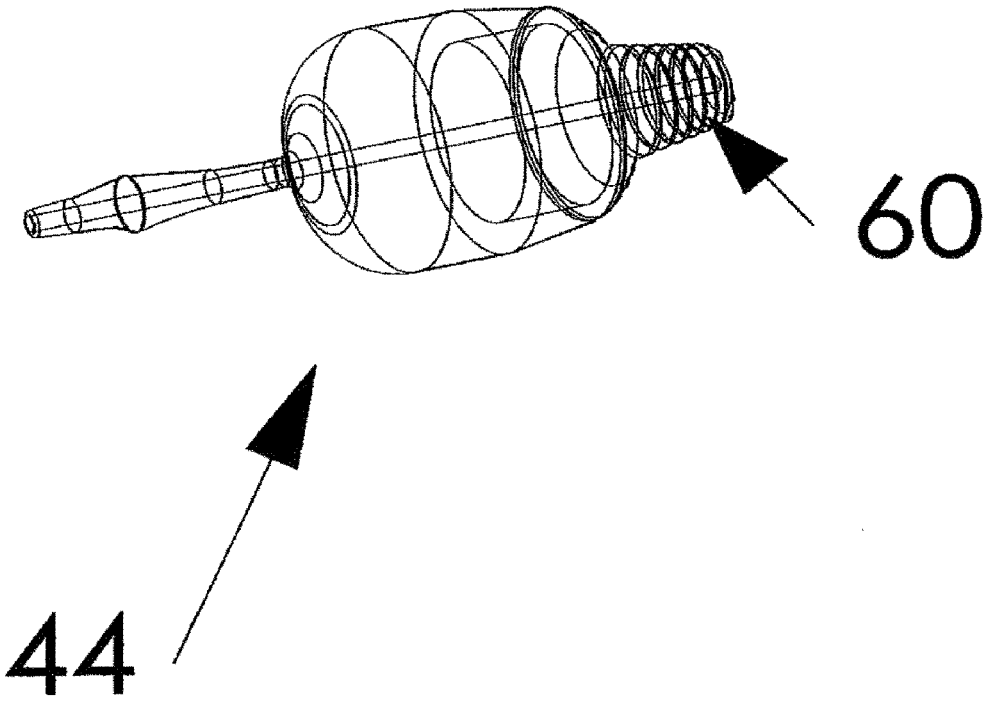
FIG. 13 is a perspective view of the false-trigger-reducing resilient piece that can be used as a part of the second probe shown in FIG. 12.
Figure 14:
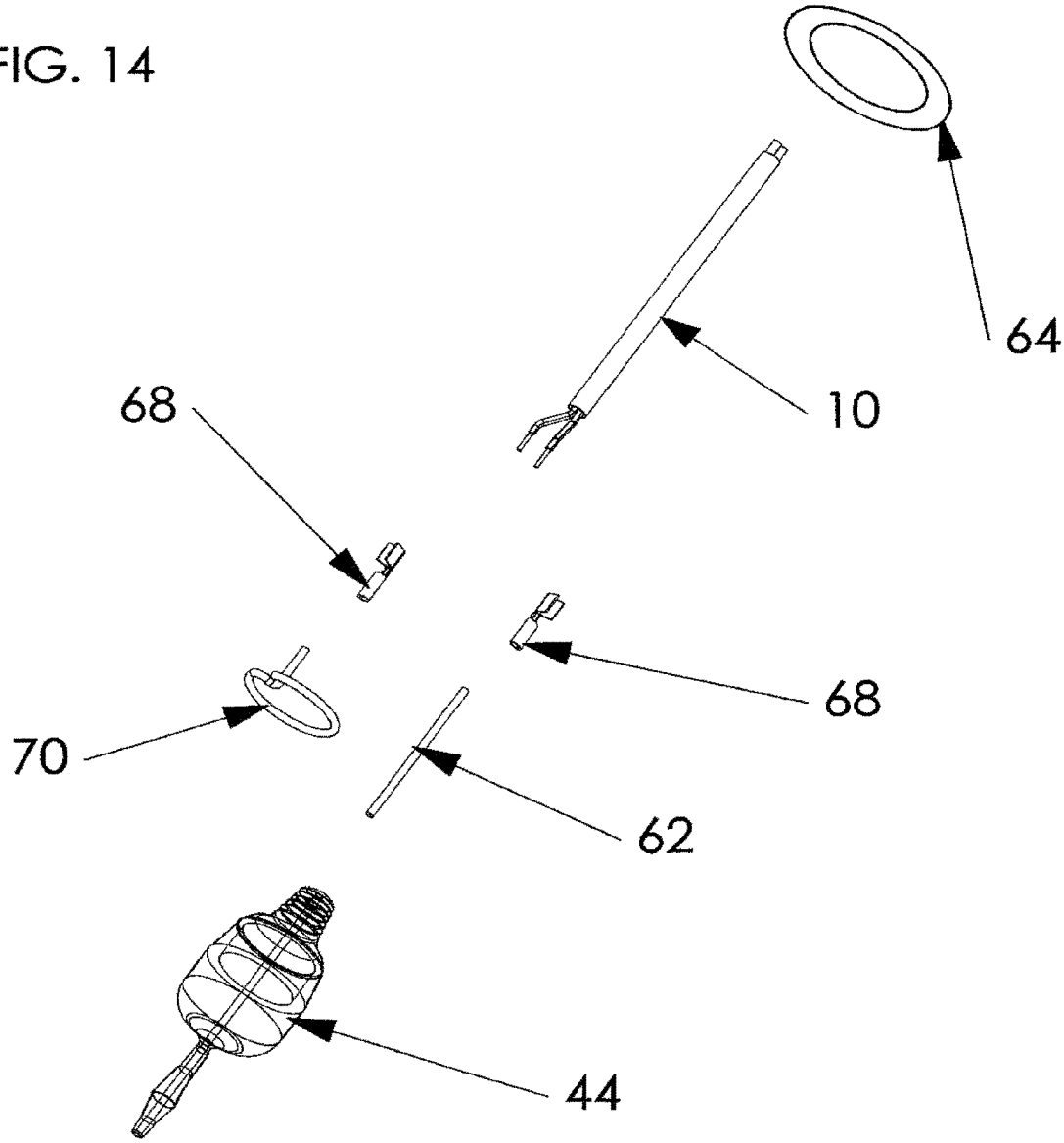
FIG. 14 is an exploded view of the second probe shown in FIG. 12.

FIGS. 9-14 show more detail about two alternative embodiments of fluid-sensing probe that can be used as a part of the present invention. FIG. 9 is a perspective view of the probe shown in FIG. 6, while FIG. 10 is a top view of the probe shown in FIG. 9 and FIG. 11 is an exploded view of the probe shown in FIG. 9. In contrast, FIG. 12 is an exploded view of a second probe that can be used in preferred embodiments of the present invention, FIG. 13 is a perspective view of the false-trigger-reducing resilient piece that can be used as a part of the second probe shown in FIG. 12, and FIG. 14 provides an exploded view of the second probe shown in FIG. 12. In FIG. 9 one can see a first preferred embodiment of the electronic fluid-sensing probe in the present invention with two non-circular power potentials 62 that are needed for activation of signal-generating unit 4. As can be seen in FIG. 11, one power potential 62 (the left one) is longer that the other, so as to reduce the likelihood of false triggering for signal-generating unit 4. FIG. 9 also shows a false-trigger-reducing resilient piece 44 surrounding both power potentials 62, with its partial cone-shaped structure providing a drip path to wick fluid away from the more highly elevated power potential 62. In addition, FIG. 9 shows electrical wiring 10 in contact with the protective over-molding 60 at the proximal end of false-trigger-reducing resilient piece 44 used to protect electrical wiring 10 as it enters cap 16, and electrical wiring 10 and power potentials 62 centrally associated with cap 16. The female threads 38 of cap 16 are also visible in FIG. 9, as are the rotation-assisting projections 58 on the external portion of cap 16. The simple interior structure of the fluid-sensing probe lowers manufacturing cost, and since there is no deployable float involved, installation is simple and easy. In contrast, FIG. 10 shows electrical wiring 10 as it enters cap 16 and in contact with the protective over-molding 60 at the proximal end of false-trigger-reducing resilient piece 44 that extends through cap 16 to provide a waterproof seal around electrical wiring 10. Information markings 40 are shown on the exterior surface of cap 16, but are not critical, and the rotation-assisting projections 58 on the external portion of cap 16 are also visible. Extending from the inside surface of cap 16, one can see the false-trigger-reducing resilient piece 44 around each power potential 62 (which are not marked by their identifying numerical designation due space limitation in FIG. 10. FIG. 11 shows the first preferred embodiment of a present invention fluid-sensing probe in exploded array. Starting at the top of the illustration in FIG. 11, the cap 16 that supports the present invention fluid-sensing probe in its association with access port 12, is shown adjacent to an O-ring 64, which is used with cap 16 to provide a waterproof seal for the selected opening 52 or 56 in access port 12 to which it becomes attached. Electrical wiring 10 is shown below cap 16, as a portion of it extends through cap 16. Before the end 36B of electrical wiring 10 is separated into two wires that each become independently connected to a different electrical clip 68, electrical wiring 10 extends through the extension 66 depending from over-molding 60 that assists positioning of electrical clips 68 and power potentials 62 to reduce the opportunity for moisture accumulation that might otherwise lead to false-triggering of signal-generating unit 4. Each electrical clip 68 is crimped on one of its ends around a different one of the wires in the end 36B of electrical wiring 10, and a different one of the power potentials 62 is secured to the opposing end of each electrical clip 68. As noted above, one of the power potentials should be shorter that the other, to reduce false triggering of signal-generating unit 4. In FIG. 11, the left power potential 62 is shown to be longer than the power potential 62 positioned to its right. Below the two power potentials in FIG. 11, one can see false-trigger-reducing resilient piece 44 and the inner protective member 72 for non-circular sensing probes 62 that is used within false-trigger-reducing resilient piece 44 and assists in wicking moisture away from the shorter power potentials 62.

In contrast, FIGS. 12-14 show a second preferred embodiment of a present invention fluid-sensing probe. Although the two preferred fluid-sensing probes shown in FIGS. 9-14 are shown, it is not contemplated for the selection of fluid-sensing probes that can be used as a part of the present invention water detection assembly disclosed herein to be limited only to these two probes. FIG. 12 shows the second preferred embodiment of a present invention fluid-sensing probe in assembled condition, without cap 16, although O-ring 64 that provides a waterproof seal for cap 16 remains in view. The second preferred embodiment of a present invention fluid-sensing probe has one circular power potential 70, and a second non-circular power potential 62 in a lower position that is closer to the distal end of false-trigger-reducing resilient piece 44 than the location of circular power potential 70. False-trigger-reducing resilient piece 44 is shown to extend around non-circular power potential 62, but not circular power potential 70. Furthermore, in FIG. 12 the over-molding 60 that provides a waterproof seal around electrical wiring 10 as it enters cap 16 is shown to be a part of false-trigger-reducing resilient piece 44. At least one electrical clip 68 is also visible in FIG. 12 within false-trigger-reducing resilient piece 44, however it is not marked with a numerical identification for clarity of illustration. In FIG. 13, the structure of the false-trigger-reducing resilient piece 44 in the second preferred embodiment of a present invention fluid-sensing probe is shown with its integral protective over-molding 60 that is configured to provide a waterproof seal around electrical wiring 10 as it extends through cap 16. Starting at the top of the illustration in FIG. 14, the O-ring 64 that is used with cap 16 to provide a waterproof seal for the selected opening 52 or 56 in access port 12 to which it becomes attached is first visible, and positioned above electrical wiring 10. Two electrical clips 68 are shown below the separated wires in the lower end of electrical wiring 10, and a different electrical clip 68 becomes attached to each of the separated wires in the lower end of electrical wiring 10. Attachment of each electrical clip 68 to one electrical wiring 10 is preferably achieved by crimping. Below the electrical clips 68 are one non-circular power potential 62 and one circular power potential 70, and the false-trigger-reducing resilient piece 44 that covers and protects non-circular sensing probe 62.

While at least one exemplary embodiment has been presented in the foregoing detailed description of the invention, it should be appreciated that a vast number of variations exist, and the description herein is not intended to limit the scope, applicability, or configuration of the invention in any way, which is set forth in the appended claims. In addition, it should be noted that in this disclosure the relational terms used are solely to distinguish the preferred structure disclosed herein, without necessarily requiring or implying any such relationship or order between such structure or actions. Furthermore, the terms "includes", "including", or any other variation thereof, are intended to cover a non-exclusive grouping that may include other elements not expressly listed or inherent to such process, method, article, or apparatus. Also, an element proceeded by "includes . . . a" does not, without more constraints, preclude the existence of additional identical elements in the process, method, article, or apparatus that comprises the element.

What is claimed is:

1. A water detection assembly for use with a primary drain line that is employed to remove collected condensate and other fluid from a primary drain pan located under a fluid-producing unit, said assembly comprising:

an access port connected in-line with a primary drain line employed to carry collected condensate and other fluid away from a fluid-producing unit so as to create an upstream portion of the primary drain line and a downstream portion of the primary drain line, said access port having a non-threaded end, an end opening with external threads located in a position opposed from said non-threaded end, and a side opening with external threads, said end opening with external threads and said side opening with external threads positioned adjacent to one another, said non-threaded end opening being configured for connection to the primary drain line and a selected one of said other openings also being connected to the primary drain line, said access port further having an internal step-down fluid-collecting area adjacent to and communicating with said end opening with external threads and also with said side opening with external threads, said step-down fluid-collecting area being configured and positioned so that during routine flow of fluid through said access port said step-down fluid collecting area remains dry, and further configured and positioned so that said step-down fluid-collection area begins to fill with fluid only when a blockage occurs in the downstream portion of the primary drain line that causes fluid entering the primary drain line to sufficiently accumulate so that it backs up and re-enters said access port, and continues to move toward said upstream portion of the primary drain line;

a cap having internal threads configured to mate with said external threads associated with said end opening in said access port and said external threads associated with said side opening in said access port;

an electronic fluid-sensing probe connected to said cap and having two power potentials, said electronic fluid-sensing probe also configured and dimensioned so that when said cap is secured to a selected one of said threaded openings in said access port a portion of said electronic fluid-sensing probe extends into said step-down fluid-collecting area; and a signal-generating unit electrically connected to said electronic fluid-sensing probe and configured with two power potentials, so that when fluid accumulates in said step-down fluid-collecting area and creates electrical connection between said two power potentials, said signal-generating unit is activated and sends a signal intended to bring about action that stops fluid build-up in the primary drain line.

2. The assembly of claim 1 further comprising a quick-disconnect connector electrically connected between said electronic fluid-sensing probe and said signal-generating unit.

3. The assembly of claim 1 further comprising sealing means adapted for providing a waterproof connection between said cap and said selected one of said threaded openings in said access port.

4. The assembly of claim 1 wherein said step-down fluid-collecting area is configured and positioned to remain dry during routine flow of fluid through said access port when said access port is installed in a horizontally extending orientation, and also when said access port is installed in a vertically extending orientation.

5. The assembly of claim 1 further comprising an adapter configured for insertion within said threaded openings of said access port, said adapter also configured for connection to and fluid communication with the primary drain line.

6. The assembly of claim 1 wherein said signal-generating unit has an external support configured for wrapping surplus length of electrical wiring.

7. The assembly of claim 1 wherein said signal-generating unit has at least one mounting tab.

8. The assembly of claim 1 wherein said signal-generating unit further comprises testing means adapted to determine proper functioning of said signal-generating unit, said testing means comprising a light and a readily-accessed and manually-operable activation device for said light, which when manually engaged will cause said light to become lit only if said signal-generating unit is properly functioning.

9. The assembly of claim 1 wherein said cap is configured to mate securely with said threaded openings in said access port and to also be readily removable from said threaded openings, and further wherein said threaded openings in said access port are each configured and dimensioned to allow maintenance access to the primary drain line connected to said access port.

10. The assembly of claim 9 wherein said step-down fluid-collecting area is also configured to allow the introduction of chemicals into the connected downstream portion of the primary drain line without any worry of retrograde backflow of the chemicals into the upstream portion of the primary drain line.

11. The assembly of claim 1 wherein said one of said power potentials in said electronic fluid-sensing probe has a circular configuration.

12. The assembly of claim 1 wherein said electronic fluid-sensing probe further comprises a false-trigger-reducing resilient piece.

13. The assembly of claim 12 wherein said false-trigger-reducing resilient piece further comprises a cone configured to direct moisture adjacent to at least one of said power potentials away from it.

14. The assembly of claim 1 wherein said non-threaded opening of said access port is connected to the upstream portion of a connected primary drain line when said access port is installed in a horizontal orientation and said non-threaded opening of said access port is connected to the downstream portion of a connected primary drain line when said access port is installed in a vertical orientation.

15. The assembly of claim 14 further comprising information marking on said access port configured to identify the direction of fluid flow within said access port during horizontal and vertical installations.

16. The assembly of claim 1 wherein said cap further comprises at least one external grip-enhancing protrusion.

17. The assembly of claim 1 wherein said step-down fluid-collecting area is configured and positioned to remain dry during routine flow of fluid through said access port when said access port is installed in a horizontally extending orientation, and also when said access port is installed in a vertically extending orientation.

18. The assembly of claim 1 wherein said one of said power potentials in said electronic fluid-sensing probe has a circular configuration.

19. The assembly of claim 1 wherein said non-threaded opening of said access port is connected to the upstream portion of a connected primary drain line when said access port is installed in a horizontal orientation and said non-threaded opening of said access port is connected to the downstream portion of a connected primary drain line when said access port is installed in a vertical orientation, and said access port further comprising information marking thereon configured to identify the direction of fluid flow within said access port during horizontal and vertical installations.

20. A water detection assembly for use with a primary drain line that is employed to remove collected condensate and other fluid from a primary drain pan located under a fluid-producing unit, said assembly comprising:

an access port connected in-line with a primary drain line employed to carry collected condensate and other fluid away from a fluid-producing unit so as to create an upstream portion of the primary drain line and a downstream portion of the primary drain line, said access port having a non-threaded end, an end opening with external threads located in a position opposed from said non-threaded end, and a side opening with external threads, said end opening with external threads and said side opening with external threads positioned adjacent to one another, said non-threaded end opening being configured for connection to the primary drain line and a selected one of said other openings also being connected to the primary drain line, said access port further having an internal step-down fluid-collecting area adjacent to and communicating with said end opening with external threads and also with said side opening with external threads, said step-down fluid-collecting area being configured and positioned so that during routine flow of fluid through said access port said step-down fluid collecting area remains dry, and further configured and positioned so that said step-down fluid-collection area begins to fill with fluid only when a blockage occurs in the downstream portion of the primary drain line that causes fluid entering the primary drain line to sufficiently accumulate so that it backs up and re-enters said access port, and continues to move toward said upstream portion of the primary drain line;

a cap having internal threads configured to mate with said external threads associated with said end opening in said access port and said external threads associated with said side opening in said access port;

an electronic fluid-sensing probe connected to said cap and having two power potentials, said electronic fluid-sensing probe also configured and dimensioned so that when said cap is secured to a selected one of said threaded openings in said access port a portion of said electronic fluid-sensing probe extends into said step-down fluid-collecting area, said electronic fluid-sensing probe further comprises a false-trigger-reducing resilient piece;

a signal-generating unit electrically connected to said electronic fluid-sensing probe and configured with two power potentials, said signal-generating unit further comprising testing means adapted to determine proper functioning of said signal-generating unit, said testing means comprising a light and a readily-accessed and manually-operable activation device for said light, which when manually engaged will cause said light to become lit only if said signal-generating unit is properly functioning, so that when fluid accumulates in said step-down fluid-collecting area and creates electrical connection between said two power potentials, said signal-generating unit is activated and sends a signal intended to bring about action that stops fluid build-up in the primary drain line; and a quick-disconnect connector electrically connected between said electronic fluid-sensing probe and said signal-generating unit.

* * * * *